US007431302B2

(12) United States Patent
Bassett et al.

(10) Patent No.: US 7,431,302 B2
(45) Date of Patent: Oct. 7, 2008

(54) MODULAR BALLISTIC WALL AND TARGET SYSTEM

(75) Inventors: David Bassett, Provo, UT (US); Kyle Bateman, Provo, UT (US)

(73) Assignee: Action Target, Inc., Provo, UT (US)

( * ) Notice: Subject to any disclaimer, the term of this patent is extended or adjusted under 35 U.S.C. 154(b) by 0 days.

(21) Appl. No.: 11/513,319

(22) Filed: Aug. 29, 2006

(65) Prior Publication Data

US 2007/0114724 A1 May 24, 2007

Related U.S. Application Data

(60) Provisional application No. 60/712,633, filed on Aug. 30, 2005.

(51) Int. Cl.
*F41J 1/10* (2006.01)

(52) U.S. Cl. ..... 273/407; 273/406

(58) Field of Classification Search ..... 273/390–392, 273/403–410

See application file for complete search history.

(56) References Cited

U.S. PATENT DOCUMENTS

| | | | | |
|---|---|---|---|---|
| 980,255 | A | 1/1911 | Herms et al. | |
| 1,803,514 | A | 5/1931 | Thomas | |
| 2,104,171 | A | 1/1938 | Schwerin | |
| 2,706,634 | A | 4/1955 | Van Valkenburg | |
| 2,855,871 | A | 10/1958 | Huntington | |
| 3,927,500 | A | 12/1975 | Plumlee | |
| 3,982,761 | A | 9/1976 | DeVogelaere | |
| 4,691,925 | A | 9/1987 | Scholem | |
| 4,723,749 | A | 2/1988 | Carraro et al. | |
| 4,743,032 | A | 5/1988 | Summers et al. | |
| D329,680 | S | 9/1992 | Burn | |
| 5,163,689 | A | 11/1992 | Bateman | |
| 5,232,227 | A | 8/1993 | Bateman | |
| 5,259,291 | A | 11/1993 | Wilson | |
| 5,324,043 | A * | 6/1994 | Estrella | 273/392 |
| 5,433,451 | A | 7/1995 | De Vries | |
| 5,655,775 | A * | 8/1997 | Pontus et al. | 273/410 |
| 5,822,936 | A | 10/1998 | Bateman | |
| 6,502,820 | B2 | 1/2003 | Slifko | |
| 6,575,753 | B2 | 6/2003 | Rosa et al. | |
| 6,776,418 | B1 | 8/2004 | Sovine et al. | |
| 6,808,177 | B2 | 10/2004 | Dehart | |
| 2002/0158413 | A1 * | 10/2002 | Dehart | 273/390 |

FOREIGN PATENT DOCUMENTS

EP 1593927 A1 * 11/2005

OTHER PUBLICATIONS

Duelatron, Product Literature 1995.
Porta Target, Product Literature, Circa 2000.

* cited by examiner

*Primary Examiner*—Mark S Graham
(74) *Attorney, Agent, or Firm*—Bateman IP Law Group

(57) ABSTRACT

A modular target system utilizes standard sized pieces which may be releasably attached to form a target system. The size of the target system may be easily customized as well as the number and types of targets which are mounted to the target system.

19 Claims, 10 Drawing Sheets

MODULAR BALLISTIC WALL AND TARGET SYSTEM

RELATED APPLICATIONS

The present application claims the benefit of U.S. Provisional Application Ser. No. 60/712,633, filed Aug. 30, 2005, which is incorporated herein in its entirety.

BACKGROUND OF THE INVENTION

1. The Field of the Invention

The present invention relates to a ballistic wall and target system. More specifically, the present invention relates to a modular ballistic wall and target system, providing a target system which is more flexible to use and which is easier to set up and modify.

2. State of the Art

Ballistic walls and target systems are used in shooting ranges and the like. Existing target systems use a ballistic wall which is formed from a piece of plate steel or multiple pieces of plate steel which have been welded together. The ballistic wall is welded to a base or stand. Targets may be mounted to the ballistic wall. Target stands may be welded to the ballistic wall or to the base and used to attach targets to the target system. It is also common to weld brackets to the back side of the ballistic wall and attach a target to the bracket. Target systems known in the prior art are not modular, as the individual parts are typically welded together. The target systems are thus difficult to customize by adding or subtracting pieces, by changing the types and mounting locations of targets, etc.

The available target systems have several disadvantages. First, extensive welding is required to assemble the structure. The target system must then be shipped as a large structure or welded together on site. The target systems are typically permanent structures. Because the structure is welded together, it often is difficult to move the structure. Additionally, the target system can not be modified without cutting or welding, making modifications difficult.

An additional disadvantage of the system is the welding process itself. The ballistic wall is typically configured to serve as a bullet deflection plate and to prevent bullets from striking the objects behind the ballistic wall, typically target actuators. Welding, however, can weaken the steel. The ballistic wall and target system thus may be more likely to be damaged when hit by bullets in areas adjacent welds, increasing the risk to individuals using the target system. Furthermore, the repeated vibration of the metal caused by impacts from the bullets can weaken the welds and cause them to break over time.

It is thus desirable to provide a ballistic wall and target system which allows an individual to easily customize the target system. It is further desirable to provide a target system which is modular so as to allow an individual to easily add to or subtract from the target system. It is further desirable to provide a target system which may be easily assembled using commonly available tools.

SUMMARY OF THE INVENTION

It is an object of the present invention to provide an improved modular target system.

According to one aspect of the present invention, a target system is provided wherein standard sized pieces are used. The pieces are thus interchangeable during assembly and may be easily replaced if damaged.

According to another aspect of the present invention, a target system is provided wherein the pieces may be removably assembled using commonly available tools. Fasteners such as nuts and bolts are used to assemble the target system, allowing the system to be shipped in a more compact state and then easily assembled on site. The use of removable fasteners also allows for easy replacement of damaged pieces and for easy enlargement or reduction in size of the target system.

According to another aspect of the present invention, a target system is provided with a plurality of attachment locations. Targets, target actuators, mounting rails, and the like may be attached in any number of different locations and mounting orientations. It is thus possible to mount a large number of different targets to the present target system, and to alter the location of the targets when desired.

These and other aspects of the present invention are realized in a modular target system as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The various embodiments shown accomplish various aspects and objects of the invention. Furthermore, it will be appreciated that various aspects of each embodiment may be used interchangeably, and, for the sake of brevity, all possible combinations are not specifically shown and discussed regarding each embodiment.

DETAILED DESCRIPTION

The drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
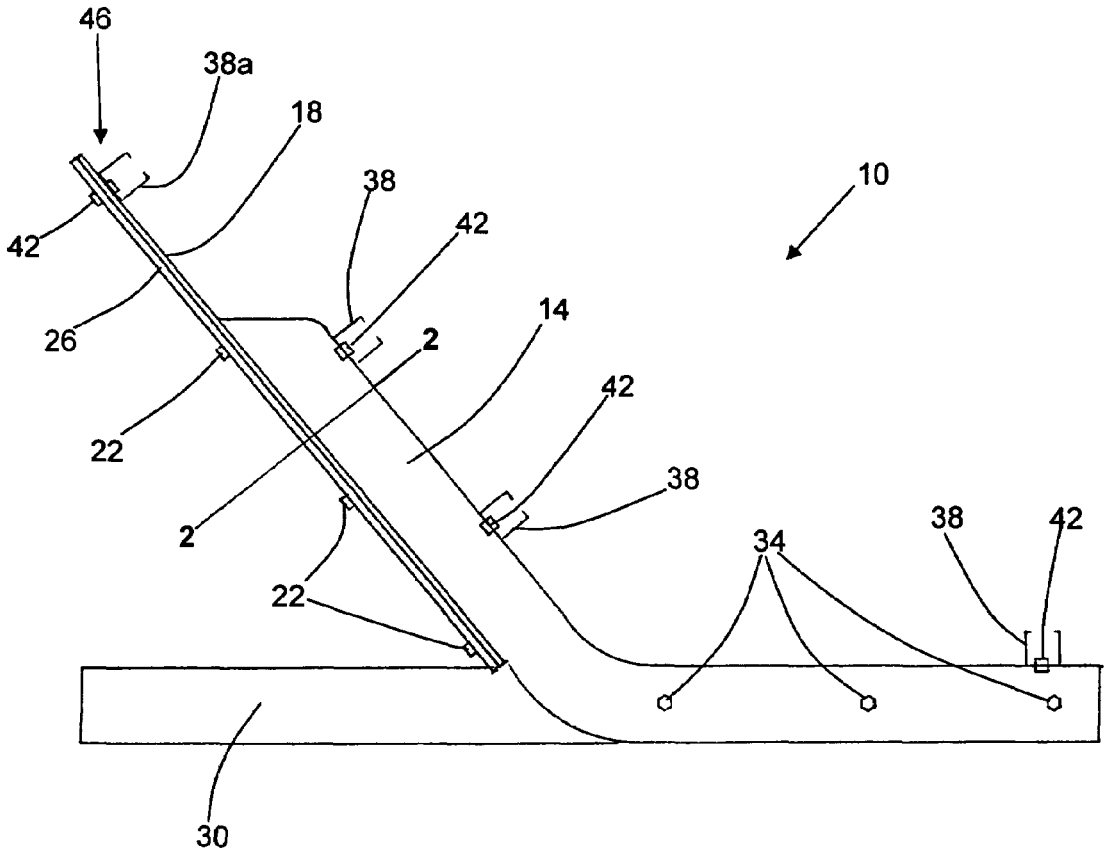
FIG. 1 shows a side view of a target system according to the present invention.

Turning to FIG. 1, a side view of a target system base according to the present invention is shown. The target system base, indicated generally at 10, uses support members 14 to hold bullet deflecting plates 18 in a desired position. The support members 14 are typically placed at joints between adjacent bullet deflecting plates 18 such that the plates 18 may be fastened to the support members 14 without forming holes in the plates. It is advantageous to avoid forming holes in the plates 18 because the plates 18 are typically hardened steel, and forming holes is relatively difficult and increases the expense of forming a target system. Additionally, some methods of forming holes can weaken the steel. However, it will be appreciated that the present invention does not exclude the use of holes.

Fasteners 22, typically nuts and bolts, are used to attach the plates 18 to the support members 14. Holes are formed in the support members 14 for receiving the fasteners 22, which extend through the holes and through facing strips 26 which also cover the joint between adjacent plates 18, preventing bullets from passing through the joint. The fasteners are typically bolts, and preferably carriage bolts or flat head bolts which are countersunk to minimize the portion of the bolt extending beyond the facing strip.

The support members 14 may be bolted or otherwise attached to a concrete floor or other suitable surface to thereby secure the target system 10. If it is not feasible or desirable to thus attach the support members 14 to the ground, a base member in the form of feet 30, typically formed from channel steel, may be attached to the support members 14 using fasteners 34 such as bolts as shown, via welding, or other fastener mechanisms. The feet 30 support the weight of the system 10.

Rails 38 may be attached with bolts 42 or other fasteners to the back side of the target system, such as to the plates 18 or more preferably to the support members 14. The rails 38 provide a convenient mounting location for targets and other equipment. These rails 38 may be mounted to the support members 14, or may be attached to the bullet deflecting plates 18 as is shown at area 46. The rails 38 are typically mounted horizontally across the length of the target system base so as to provide mounting locations for targets, target actuators, etc. A rail 38*a* mounted to the bullet deflecting plates 18 near the top of the plates works in combination with the facing strips 26 and braces the steel plates 18 such that it is not necessary that the support member 14 extend the entire height of the steel plates. If necessary, additional rails or mounting brackets may easily be attached to the target system 10 via the support members 14 or the rails 38.

It will be appreciated that the rails 38 can have virtually any desired cross-section. While shown herein as being generally U-shaped, the rails can be solid or tubular, round, triangle, etc. The cross-section of the rails 38 will preferentially be decided by the form of attachment used to secure targets thereon, and the method by which the rails are secured to the support members 14 and/or bullet deflecting plates 18.

Bullet deflecting plates 18 are mounted at an angle less than vertical, and such that they are leaning towards a shooter. The plates 18 are typically mounted at an angel between 30 and 60 degrees. Bullets which strike the plates 18 are deflected towards the ground, reducing dangerous ricochets.

The support members 14, rails 38, etc., provide mounting locations for any number of different target types. The support members 14, bullet deflecting plates 18, facing strips 26, legs 30, etc. may be provided in standardized lengths. This allows for a modular system wherein the pieces need not be assembled in any particular order. A target system may be lengthened by simply adding a new section on to an end of the existing target system. Additionally, the targets can be spaced at any desired interval along the rails to provide any desired target spacing.

Figure 2:
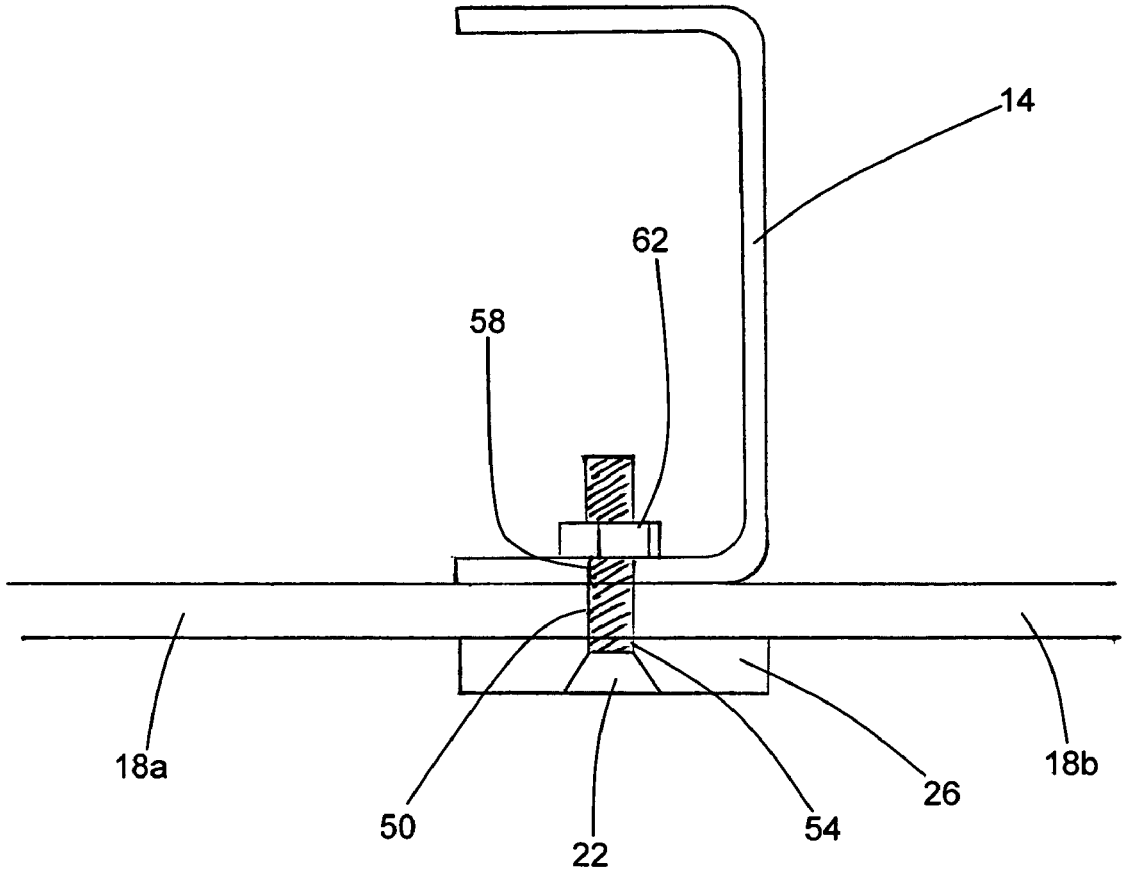
FIG. 2 shows a cross sectional view of a target system taken along line 2-2 of FIG. 1.

Turning now to FIG. 2, a cross sectional view of the target system of FIG. 1 is shown taken along line 2-2. FIG. 2 shows more clearly the attachment of the bullet deflecting plates 18 to the support member 14. A first bullet deflecting plate 18*a* and a second bullet deflecting plate 18*b* are placed adjacent each other such that the joint 50 between the plates 18*a*, 18*b* is disposed adjacent the support member 14. A facing strip 26 is placed over the joint 50. The facing strip 26 has holes 54 formed therein such that a bolt 22 may pass through the facing strip 22, joint 50, and through a hole 58 formed in support member 14. A nut 62 is then used to tighten the resulting assembly so as to rigidly attach the plates 18*a*, 18*b* to the support member 14 and prevent bullets from passing through the joint 50 between the plates 18*a*, 18*b*. While shown as being formed from channel steel, the support member 14 may be formed from a variety of differently shaped material. Likewise, while not preferred, holes can be formed in each plate and a pair of bolts may be used to secure the plates to the support member 14.

Figure 3:
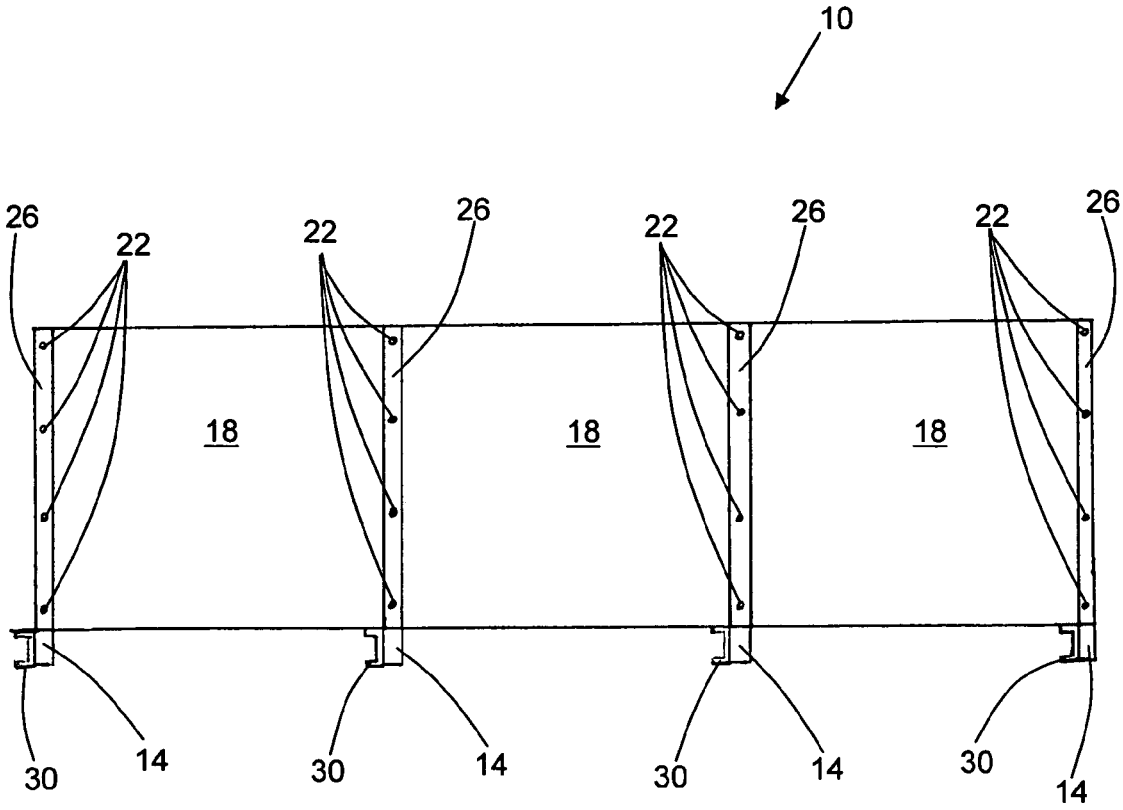
FIG. 3 shows a front view of a target system according to the present invention.

Turning now to FIG. 3, a front view of a target system according to the present invention is shown. The target system 10 is constructed with a plurality of bullet deflecting plates 18 and accordingly has a plurality of support members 14, base members/legs 30 if necessary, facing strips 26, and bolts 22 which hold the plates together and at the desired angle. One significant advantage of a target system 10 according to the present invention is that the target system 10 is modular, allowing an individual to use as many sections of the target system as is desired. If the bullet deflecting plates 18 come in four foot lengths, for example, the target system may be made 4, 8, 12, 16, etc. feet long. The target system 10 may be made as long as is necessary for a particular application. Additionally, an existing target system 10 may be extended by simply adding a new section to the end of an existing system.

Another advantage of the present target system is the ease of construction. Welding is not necessary. The target system may be constructed using simple hand tools. The target system is thus easier to construct and requires fewer tools be brought to an installation site as compared to existing target systems which use steel panels and supporting structure which are typically welded together. A target system which is modular and is preferably not welded during construction may also be easily disassembled and moved, or may have a section thereof removed if necessary.

A target system 10 according to the present invention is advantageous as the unassembled system consists of pieces which are flat or nearly flat. The target system may be more easily stored prior to installation and may be more easily transported. A conventional target system which is welded together must be shipped or stored as a large unit, or must be welded together on site.

Figure 4:
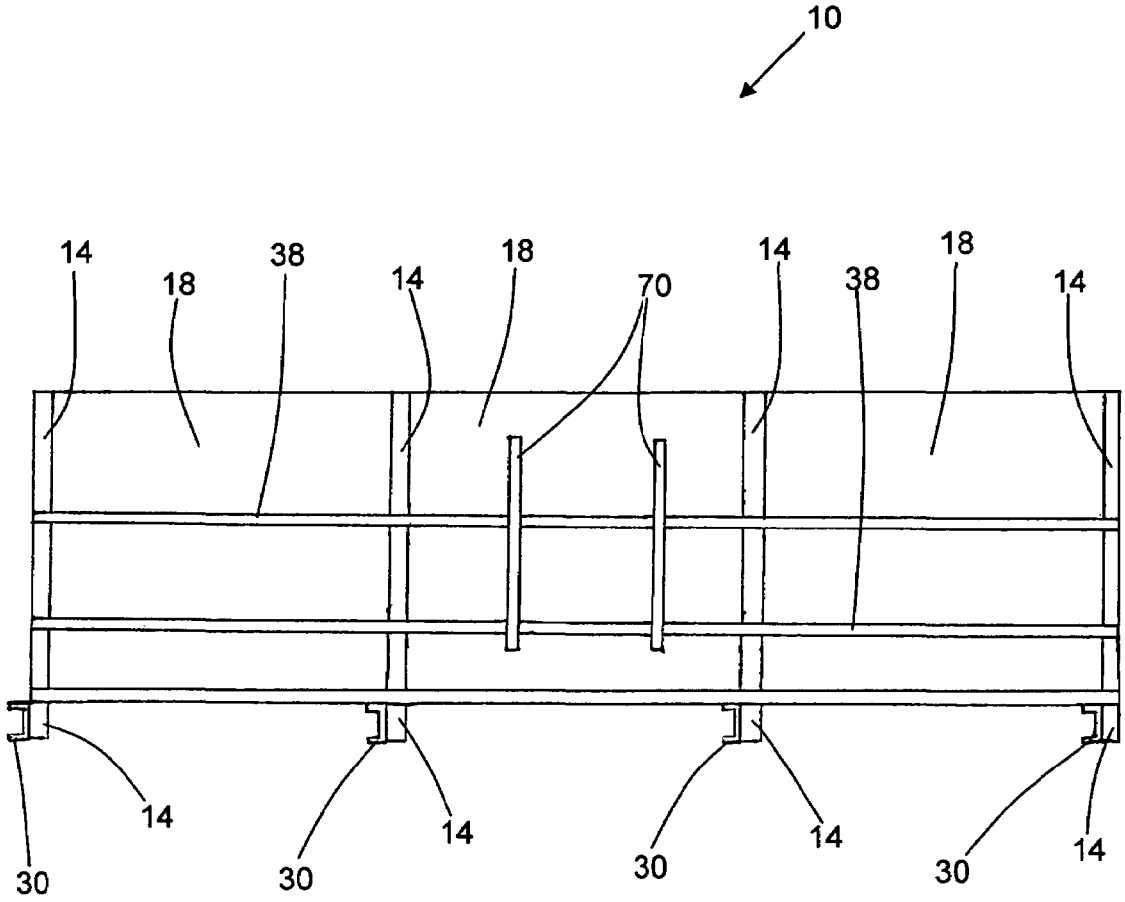
FIG. 4 shows a back view of a target system according to the present invention.

Turning now to FIG. 4, a back view of a target system according to the present invention is shown. The target system 10 is formed from three sections of bullet deflecting plate 18 and the necessary support members 14, base member/legs 30, etc. Steel rails 38 have been used to form horizontal rails extending the length of the target system 10. The rails 38 are typically used to mount targets and target actuators. The rails 38 are a significant advantage as they allow a series of targets to be mounted at a consistent height. Targets are often mounted across a shooting range at a consistent height, especially when the targets are movable targets and are ganged together for common actuation. Additionally, targets such as a "running man" target where a target moves across the shooting range are often used. The horizontal rails 38 of the present invention, such as channel 38*b*, provide a continuous mount wherein a "running man" target may be attached and made to move across the entire target system 10. With the present target system 10, a series of targets or a moving target may be made to extend across the entire length of the system, and may easily be expanded as the system is expanded in length. Vertical rails 70 or mounting rails may be attached to the horizontal rails 38, support members 14, etc. and provide additional flexibility in mounting targets to the present system.

Figure 5:
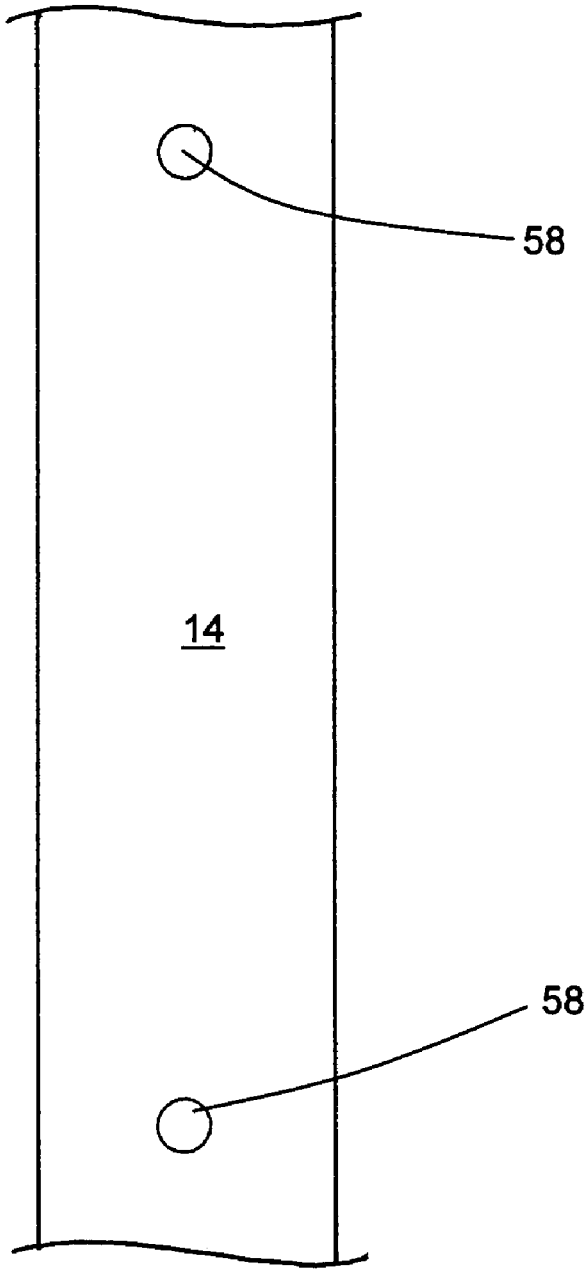
FIG. 5 shows a bottom view of a support member according to the present invention.

Turning now to FIG. 5, a bottom view of a support member according to the present invention is shown. The support member 14 is formed with holes 58 configured for attaching the plates 18 (not shown) and facing strips 26 (not shown). The size and spacing of the holes may be varied as is necessary for a particular application.

Figure 6:
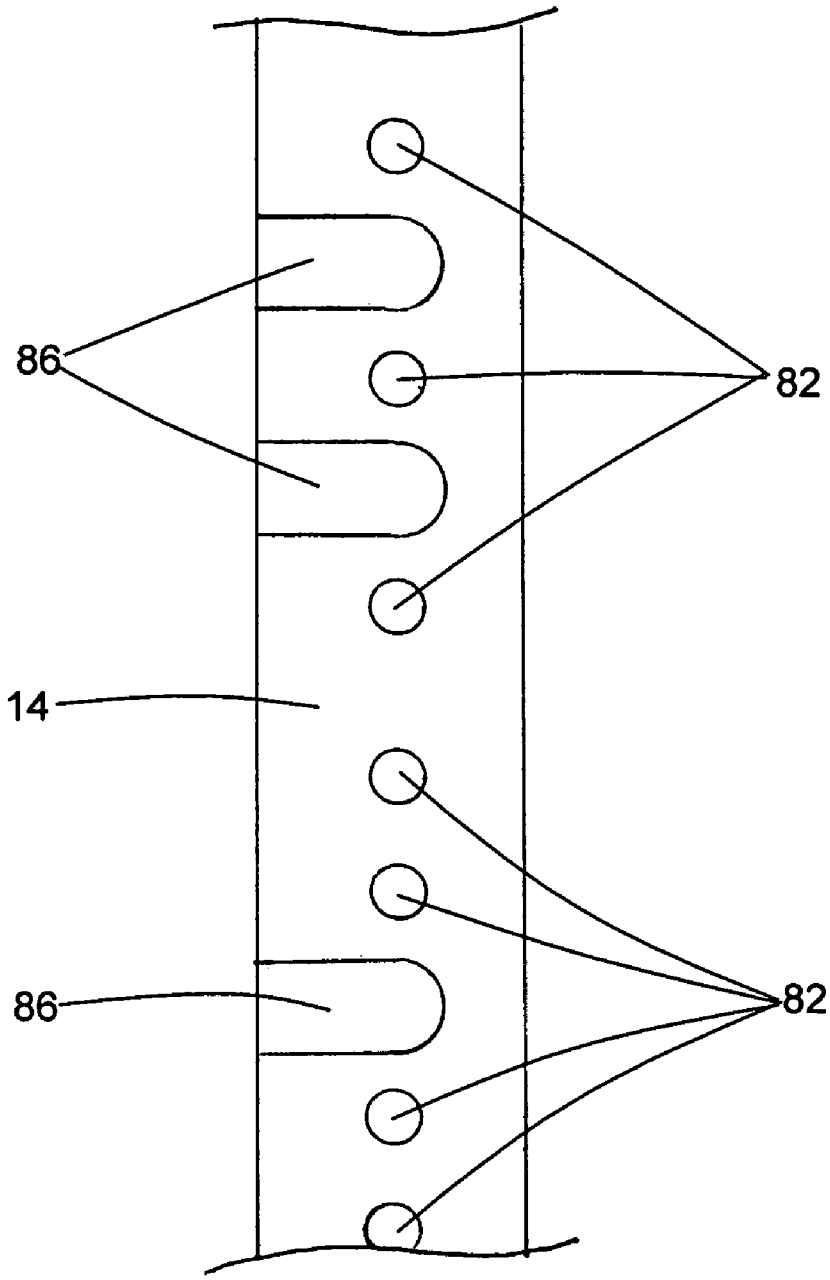
FIG. 6 shows a top view of a support member according to the present invention.

Turning now to FIG. 6, a top view of a support member according to the present invention is shown. The support member 14 is formed with a plurality of holes 82 and optional slots 86 whereby targets, target actuators, target controllers, mounting rails, mounting brackets, etc. may be attached to the support member 14. The optional slots 86 can be used to provide access to the nuts used to secure the bullet deflecting plates (not shown) to the support member, or to facilitate various attachment mechanisms.

The target system provides flexibility in mounting targets, target actuators, and the like, as these may be attached to the support members 14, or to brackets, attachment rails, or rails, which are attached to the target system. Providing a number of mounting holes 82 and slots 86 allows a wide variety of targets, actuators, controllers, etc. to be mounted to the target system. Many different shapes, sizes, and types of targets and related equipment may easily be accommodated in the present target system.

Figure 7:
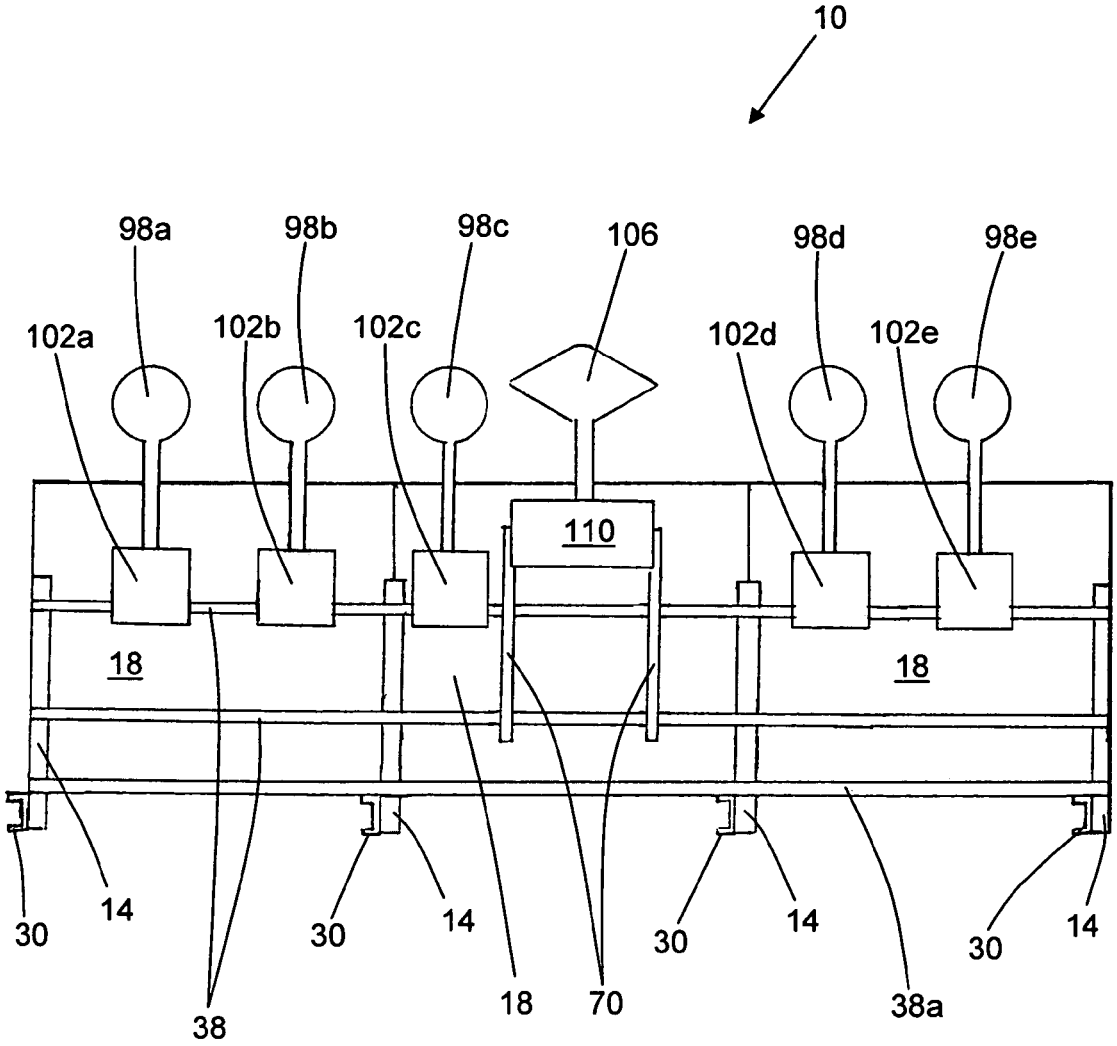
FIG. 7 shows a back view of a target system of the present invention.

Turning now to FIG. 7, a back view of a target system according to the present invention is shown. The target system 10 is similar to that of FIG. 4. A variety of different targets and target actuators have been mounted to the support members 14. A first type of target 98*a*-98*e* and target actuator 102*a*-102*e* have been mounted to a horizontal mounting rail 38. The support members 14 and associated mounting rails 38 allow an individual to easily mount a series or targets 98*a*-98*e* at a consistent height and at any desired spacing. Targets 98*a*-98*e* may easily be ganged together for common operation. If the target actuators 102*a*-102*e* were not all mounted at the proper height or spacing, it can become more difficult to connect the actuators 102*a*-102*e* to a common actuation means, such as a rope or cable. The height and spacing of targets 98*a*-98*e* and associated target actuators 102*a*-102*e* may be easily adjusted by varying the mounting holes and slots (FIG. 6) used to mount the targets or mounting rails 38. A second type of target 106 and target actuator 110 are mounted to vertical rails 70. It will be appreciated that the flexibility of the present target system allows an individual to mount many different types of targets and actuators to the target system and to reconfigure the system whenever desired. Many different types of target actuators may be used, including cable driven actuators, electrical actuators, pneumatic actuators, etc. The actuators may function in many ways, such as twisting the targets, raising and lowering the targets, etc. Target actuators may function by turning the targets between various rotational positions, such as by not presenting a target to a shooter (possibly by orienting the target edge on to a shooter), rotating the target by 90 degrees one direction to present a first side to a shooter, and/or by rotating the target by 90 degrees in the opposite direction to present the second side of the target to the shooter. A significant advantage of the present invention is the ability to easily mount any desired combination of targets and target actuators to the mounting structures, the actuators and mounts being protected from fire by the plates 18.

Figure 8:
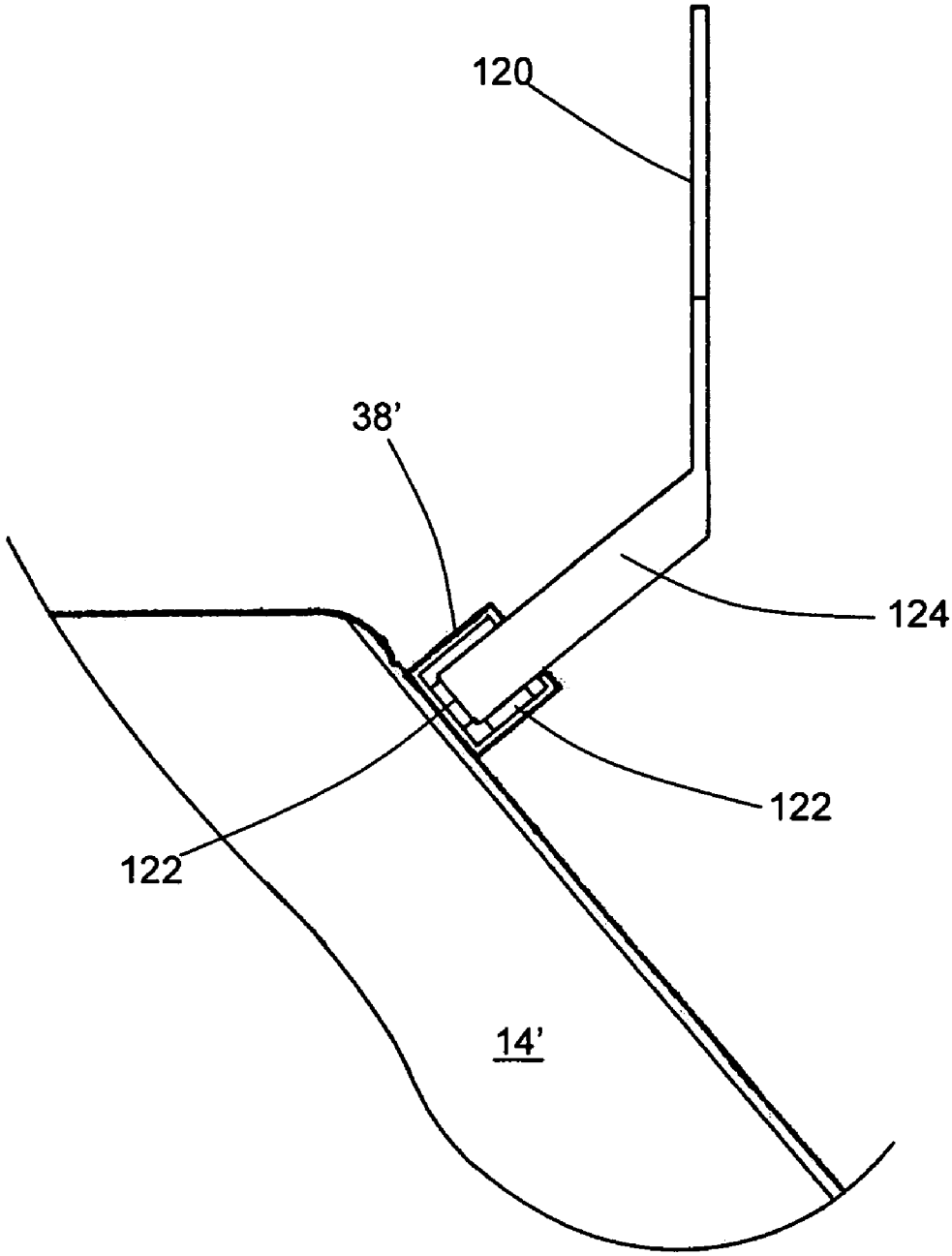
FIG. 8 shows a close-up view of a mechanism for attaching target mounting rails to support members and for attaching targets to the mounting rails.

Turning now to FIG.8, there is shown a close up view of a mechanism for attaching target mounting rails 38' to support members 14' and for attaching targets 120 to the mounting rails. Rather than using a bolt to secure the mounting rail 38' to the support member 14, the two are secured to one another by magnets 122. Likewise, the target base 124 is secured at a desired position within the mounting rail 38' by a magnet 122. In such a manner, the support member 14' need not be provided with a hole for attaching the mounting rail 38'.

Figure 9:
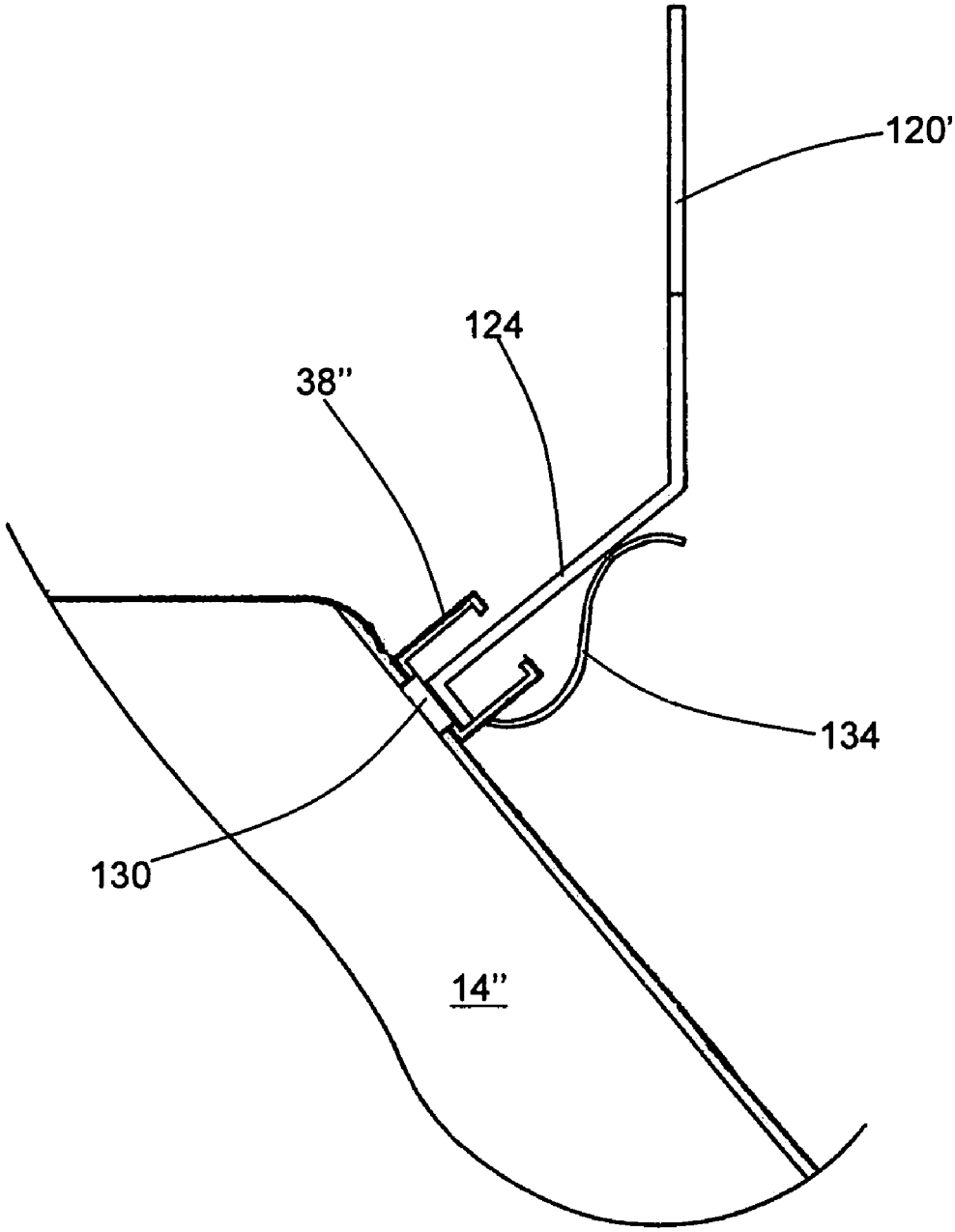
FIG. 9 shows a close-up view of an alternate arrangement for attaching target mounting rails to support members and for attaching targets to the mounting rails.

Likewise, FIG. 9 shows a close-up view of an alternate arrangement for attaching a target mounting rail 38" to a support members 14" and for attaching a target 120' to the mounting rail. Rather than using bolts or magnets, the mounting rail 38" is held to the support member 14" by a clamp 130. Likewise, the base 124' of the target 120' includes a clamp 134 to hold the target at the desired location along the mounting rail 38". In such a configuration, the target 120' can be readibly moved along the mounting rail 38" by simply releasing the clamp and sliding the target to the new desired location along the mounting rail.

Figure 10:
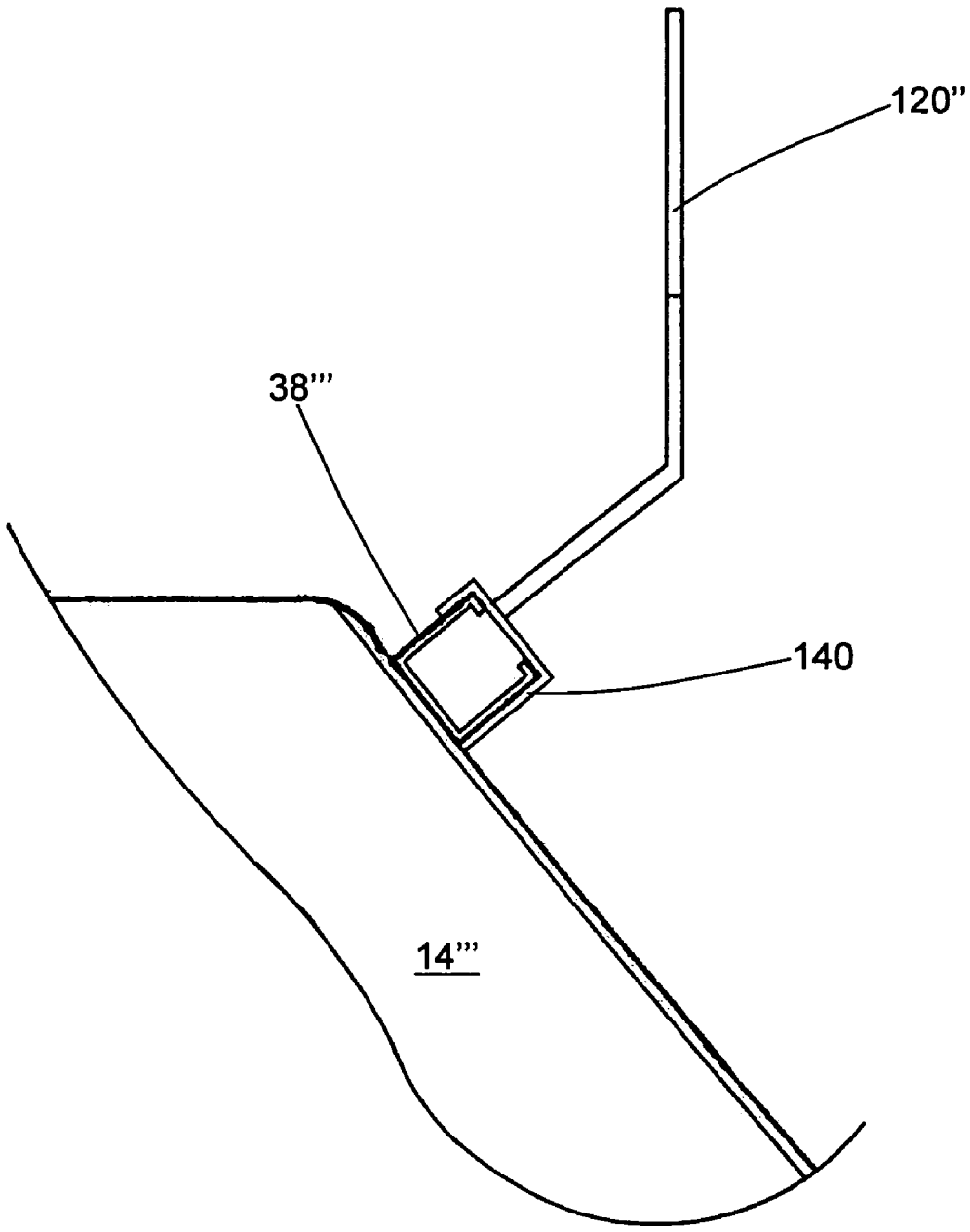
FIG. 10 shows a close-up view of yet another arrangement for attaching target mounting rails to the support members and for attaching targets to the mounting rails.

FIG. 10 shows a close-up view of yet another arrangement for attaching a target mounting rail 38''' to a support member 14''' and for attaching targets 120" to the mounting rails. Rather than using a bolt, magnet or clamp, a bracket 140 is attached to the support member 14'''. The bracket can be formed integrally, or may be welded or otherwise attached. The bracket 140 is configured so that the mounting rail 38''' is slid into a nesting arrangement or otherwise secured within the bracket. The target 120" can then be slid along the mounting rail 38''' to any desired location and secured in place. It will be appreciated by those of skill in the art that the different mechanisms for securing mounting rails to support members (or the plates) and for securing the targets to the mounting rails can be interchanged to provide whatever target adjustment dynamics and desired at the shooting range. Additionally, it will be appreciated that some targets may be attached directly to the support members.

There is thus disclosed an improved target system. The target system can be assembled with simple hand tools and may be disassembled and moved with relatively little effort. Additionally, the target system can be reconfigured, enlarged, or reduced in size without having to cut apart components. The invention is not limited to any one embodiment shown. It will be appreciated that numerous changes may be made to the present invention without departing from the scope of the appended claims.

What is claimed is:

1. A target system comprising:

a first support member having a base and an elongate upright member, the upright member extending at an angle less than vertical from the base so as to lean towards a shooter;

a second support member having a base and an elongate upright member, the upright member extending at an angle less than vertical from the base so as to lean towards a shooter;

a first bullet deflecting plate releasably attached to the upright members first support member and second support member;

at least one mount for attaching targets to at least one of the bullet deflecting plate, first support member, and second support member; and wherein the at least one mount comprises at least one target mounting rail disposed generally parallel to the upright members.

2. The system of claim 1, further comprising at least one target mounting rail disposed generally horizontally.

3. The system of claim 2, wherein at least one target mounting rail is configured for allowing targets to be releasably mounted at any position along the length of the rail.

4. The system of claim 1, further comprising a plurality of targets releasably mounted to the at least one target mounting rail.

5. The system of claim 1, wherein at least one target is mounted to a target mounting rail via a target actuator.

6. The system of claim 1, further comprising a plurality of target mounting rails disposed generally horizontally.

7. A target system comprising:

a bullet deflecting plate defining an upper edge, lower edge, and lateral edges;

plurality of supports configured for holding the bullet deflecting plate at an angle less than vertical, the supports comprising upright support arms disposed at an angle less than vertical, the bullet deflecting plate being attached to the support arms;

a first target mounting rail mounted behind the bullet deflecting plate, the first target mounting rail being configured to enable the mounting of a plurality of targets at varying positions along the length of the rail;

a plurality of targets releasably attached to the first target mounting rail; and a second target mounting rail disposed generally parallel to the support arms.

8. The system of claim 7, wherein the plurality of supports are attached to the lateral edges of the bullet deflecting plate.

9. The system of claim 7, wherein at least one of the plurality of targets is attached to the first target mounting rail via a target actuator.

10. The system of claim 7, further comprising a second plurality of targets attached to the second target mounting rail.

11. The system of claim 7, wherein the second target mounting rail is disposed generally perpendicular to the first target mounting rail.

12. The system of claim 7, wherein the first mounting rail is configured to enable the mounting of a plurality of targets at any position along the length of the rail.

13. A target mounting system comprising:

a bullet deflecting plate;

a plurality of supports releasably attached to the back of the bullet deflecting plate for holding the bullet deflecting plate at an angle less than vertical so as to lean towards a shooter, the supports comprising a base and a support arm extending upwards from the base at an angle less than vertical; and a plurality of target mounting rails mounted behind the bullet deflecting plate, at least one of the target mounting rails being attached to the bullet deflecting plate at a point above the plurality of supports, and wherein at least one rail of the plurality of mounting rails is configured for allowing targets to be releasably mounted thereto at any point along the length of the at least one rail and wherein at least one of the target mounting rails runs generally parallel to at least one of the support arms.

14. The system of claim 13, further comprising a plurality of targets releasably attached to the plurality of mounting rails.

15. The system of claim 13, wherein at least one of the target mounting rails is attached to the plurality of supports.

16. The system of claim 13, wherein the bullet deflecting plate is bolted to the support arms.

17. The system of claim 16, wherein the supports are attached to lateral edges of the bullet deflecting plate.

18. The system of claim 17, wherein the system comprises a plurality of bullet deflecting plates in a horizontal array and a plurality of supports attached to the lateral edges of the plates so as to support the plates and so as to join adjacent edges of the plates.

19. The system of claim 18, further comprising facing strips for covering adjacent edges of the bullet deflecting plates.

* * * * *